US009222293B2

(12) United States Patent
Jenkinson

(10) Patent No.: US 9,222,293 B2
(45) Date of Patent: Dec. 29, 2015

(54) HINGE ASSEMBLY FOR MOUNTING DOOR ON CABINET BELOW OPENING THEREOF

(71) Applicant: Electrolux Home Products, Inc., Charlotte, NC (US)

(72) Inventor: Peter Jenkinson, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 82 days.

(21) Appl. No.: 13/828,639

(22) Filed: Mar. 14, 2013

(65) Prior Publication Data

US 2014/0259529 A1 Sep. 18, 2014

(51) Int. Cl.

| | |
|---|---|
| ***E05D 7/00*** | (2006.01) |
| *E05F 1/06* | (2006.01) |
| *F25D 23/02* | (2006.01) |

(52) U.S. Cl.

CPC ..... *E05D 7/0027* (2013.01); *E05F 1/063* (2013.01); *E05Y 2600/634* (2013.01); *E05Y 2900/31* (2013.01); *F25D 23/028* (2013.01); *F25D 2323/024* (2013.01); *Y10T 16/5327* (2015.01)

(58) Field of Classification Search

CPC ..... E05D 7/00; E05D 7/0009; E05D 7/0018; E05D 7/0027

USPC ..... 16/244, 248, 243, 309, 312, 374, 375, 16/303, 330, 338, 340, 235

See application file for complete search history.

(56) References Cited

U.S. PATENT DOCUMENTS 686,025 A * 11/1901 Cannon ..... 16/248
4,070,728 A * 1/1978 Herman ..... 16/243
4,411,045 A * 10/1983 Rock et al. ..... 16/243
4,631,777 A * 12/1986 Takimoto ..... 16/315
4,748,717 A * 6/1988 Osborne ..... 16/240
4,864,691 A * 9/1989 Gidseg et al. ..... 16/312
5,054,163 A * 10/1991 Sterling et al. ..... 16/244
5,265,954 A * 11/1993 Keil ..... 312/405
5,369,842 A * 12/1994 Beatty ..... 16/317
7,685,678 B2 3/2010 Moon et al.

(Continued)

FOREIGN PATENT DOCUMENTS

CN 102155133 A 8/2011
CN 102322192 A 1/2012

(Continued)

OTHER PUBLICATIONS

International Search Report and Written Opinion issued in Application No. PCT/US2014/023225 dated Jul. 15, 2014.

*Primary Examiner* — Emily Morgan
(74) *Attorney, Agent, or Firm* — Pearne & Gordon LLP

(57) ABSTRACT

A hinge assembly for mounting a door on a cabinet below an opening thereof is provided. The hinge assembly may include a pin defining an axis about which the door rotates, the pin being supported by a hinge plate and including a splined portion. Moreover, the hinge assembly may include a height adjuster including an inner circumference through which the pin extends and at least a portion that is rotatable about the pin. The hinge assembly additionally may include a first cam element including a cam surface and an inner circumference through which the pin extends, the inner circumference corresponding to the splined portion of the pin for mating therewith at a single position, the first cam element being vertically adjustable along the splined portion of the pin through rotation of the rotatable portion of the height adjuster about the pin.

13 Claims, 5 Drawing Sheets

(56) References Cited

U.S. PATENT DOCUMENTS

| | | | | |
|---|---|---|---|---|
| 7,752,709 | B2 | 7/2010 | Moon et al. | |
| 8,166,612 | B2 * | 5/2012 | Bertolini et al. | 16/244 |
| 8,510,913 | B2 * | 8/2013 | Kim | 16/334 |
| 8,579,394 | B2 * | 11/2013 | Lee et al. | 312/405 |
| 2006/0143860 | A1 | 7/2006 | Park et al. | |
| 2009/0038117 | A1 | 2/2009 | Moon | |
| 2010/0218342 | A1 * | 9/2010 | Bertolini et al. | 16/244 |
| 2010/0236186 | A1 * | 9/2010 | Radford | 52/710 |
| 2011/0140585 | A1 | 6/2011 | Lee et al. | |
| 2011/0232035 | A1 * | 9/2011 | Huang et al. | 16/303 |

FOREIGN PATENT DOCUMENTS

| | | | |
|---|---|---|---|
| JP | S4894464 | U | 11/1973 |
| JP | 2006118859 | A | 5/2006 |

* cited by examiner

HINGE ASSEMBLY FOR MOUNTING DOOR ON CABINET BELOW OPENING THEREOF

BACKGROUND

1. Field

The following description relates to a hinge assembly for mounting a door on a cabinet below an opening thereof.

2. Description of Related Art

A cabinet, such as a refrigerator, often includes multiple doors that provide access to a variety of compartments. The cabinet manufacturing process may produce variations in heights of side-by-side cabinet doors, thereby providing an appearance to a prospective consumer that is undesirable and unattractive. Sometimes such variations are not noticed until the product has left the manufacturing site, thereby requiring a service technician to be dispatched to fix the problem. Moreover, subsequent alignment of the cabinet doors involves experimentation that may prove to be time-consuming.

For example, one method of cabinet door alignment involves adding shims to one or more of the hinges of a door to adjust the height thereof. However, shims are usually not available to consumers. Further, special tools must be used to make adjustments using shims. In addition, doors must be removed from the cabinet in order to add the shims.

SUMMARY

In one general aspect, there is provided a hinge assembly for mounting a door on a cabinet below an opening thereof. The hinge assembly may include a hinge plate supporting the door, the hinge plate being mounted on the cabinet below the opening thereof. The hinge assembly may further include a pin defining an axis about which the door rotates, the pin being supported by the hinge plate and including a splined portion. Moreover, the hinge assembly may include a height adjuster including an inner circumference through which the pin extends and at least a portion that is rotatable about the pin. The hinge assembly additionally may include a first cam element including a cam surface and an inner circumference through which the pin extends, the inner circumference corresponding to the splined portion of the pin for mating therewith at a single position, the first cam element being vertically adjustable along the splined portion of the pin through rotation of the rotatable portion of the height adjuster about the pin. The hinge assembly may further include a second cam element configured to rotate around the pin, the second cam element including an an inner circumference and a cam surface, the inner circumference having a diameter through which the pin extends that is greater than an outer diameter of the splined portion, the cam surface interacting with the cam surface of the first cam element upon rotation of the second cam element to control a position and an action of the door. The hinge assembly may additionally include a mounting plate onto which the second cam element is attached, the mounting plate being fastened to the door and including a projection fitting into a hole in the door, the pin being inserted into the projection, the projection being rotatable around the pin to facilitate rotation of the door about the axis. A vertical adjustment of the first cam element may serve to vertically adjust the second cam element and the mounting plate.

The height adjuster of the hinge assembly may further include a planar knurled surface facing away from the hinge plate. The first cam element may further include a knurled surface configured to mate with the planar knurled surface of the height adjuster to inhibit rotation of the rotatable portion of the height adjuster.

In addition, the hinge assembly may include a limiting plate surrounding the second cam element and the pin, the limiting plate including a tab. The hinge plate may include a stopper, the stopper being configured to inhibit the tab from passing a predetermined position to limit the rotation of the door to an angular range defined by the predetermined position at which the tab is inhibited from passing and a point at which the door meets the opening of the cabinet.

Further, the hinge assembly may include a fastener securing the limiting plate to the mounting plate. The limiting plate may further include a slot through which the fastener secures the limiting plate to the mounting plate. The predetermined position of the tab may be adjustable according to a position along the slot at which the fastener secures the limiting plate to the mounting plate.

Moreover, the hinge assembly may include a fastener securing the limiting plate to the door. The limiting plate may further include a slot through which the fastener secures the limiting plate to the door. The predetermined position of the tab may be adjustable according to a position along the slot at which the fastener secures the limiting plate to the door.

The cam surface of the first cam element may include elevated portions, depressed portions, and transitional portions connecting the elevated portions and the depressed portions.

The cam surface of the second cam element may include elevated portions, depressed portions, and transitioning portions connecting the elevated portions and the depressed portions. The elevated portions, the depressed portions, and the transitioning portions of the second cam element may interact with the elevated portions, the depressed portions, and the transitioning portions of the first cam element.

The elevated portions of the cam surface of the first cam element of the hinge assembly may divide a circumference of the first cam element into a plurality of arced zones between which the elevated portions of the cam surface of the second cam element are configured to move in order to control the position and the action of the door.

When an angular range defined by the position of the door and a point at which the door meets the opening of the cabinet is 0 to 20 degrees, the cam surface of the second cam element may interact with the cam surface of the first cam element to urge the door to the point at which the door meets the opening of the cabinet.

When an angular range defined by the position of the door and a point at which the door meets the opening of the cabinet is 125 degrees or greater, the cam surface of the second cam element may interact with the cam surface of the first cam element to maintain the angular range.

The hinge plate may include slots configured to allow mounting of the hinge plate on the cabinet below the opening thereof to be horizontally adjustable.

The hinge plate of the hinge assembly may include a rectangular hole. The pin may include a rectangular bush projecting from the pin and mating with the rectangular hole.

The pin may include a threaded portion and a cylindrical portion.

The inner circumference of the rotatable portion of the height adjuster may be threaded to interact with the threaded portion of the pin to enable the rotatable portion of the height adjuster to be rotatable about the pin.

The height adjuster may include a annular nut.

The cylindrical portion of the pin may be inserted into the projection. The projection may be cylindrical and rotatable around the cylindrical portion of the pin to facilitate the rotation of the door about the axis.

The height adjuster may further include a first wedge and a second wedge, the first and second wedges including inner circumferences through which the pin extends, the first wedge being disposed at a position that is closer to the hinge plate than a position of the second wedge, the inner circumference of the first wedge being splined to mate with the splined portion of the pin to inhibit rotation of the first wedge about the pin, the inner circumference of the second wedge having a diameter that is greater than an outer diameter of the splined portion of the pin such that the second wedge is the rotatable portion of the height adjuster, the first and second wedges having variable thicknesses to form an annular nut with one combination of the thicknesses. Rotation of the second wedge may serve to form other combinations of the thicknesses of the first and second wedges and vertically adjust the first cam element along the splined portion of the pin, the other combinations having a height that is greater than a height of the one combination.

The second wedge may further include a planar knurled surface facing away from the first wedge. The first cam element may further include a knurled surface configured to mate with the planar knurled surface of the second wedge to inhibit rotation of the second wedge.

The pin may further include a first wedge positioned next to the hinge plate, the first wedge having a varied thickness. The height adjuster may further include a second wedge, the second wedge including an inner circumference through which the pin extends, the inner circumference of the second wedge having a diameter that is greater than an outer diameter of the splined portion such that the second wedge is the rotatable portion of the height adjuster, the second wedge having a variable thickness to form an annular nut with one combination of the thicknesses of the first and second wedges. Rotation of the second wedge may serve to form other combinations of the thicknesses of the first and second wedges and vertically adjust the first cam element along the splined portion of the pin, the other combinations having a height that is greater than a height of the one combination.

The second wedge further includes a planar knurled surface facing away from the first wedge. The first cam element may further include a knurled surface configured to mate with the planar knurled surface of the second wedge to inhibit rotation of the second wedge.

Other features and aspects may be apparent from the following detailed description, the drawings, and the claims.

Figure 1:
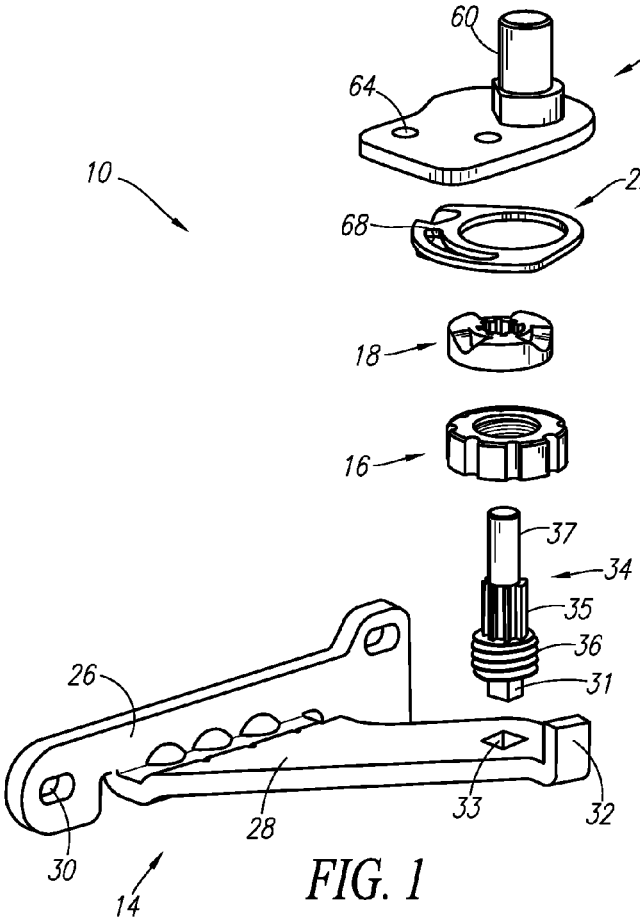
FIG. 1 is an exploded view illustrating an example of a hinge assembly for a door of an enclosed structure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Examples incorporating one or more aspects of the present invention are described and illustrated in the drawings. These illustrated examples are not intended to be limiting. For example, one or more aspects of the present invention may be utilized in other embodiments and even other types of devices.

Examples of the present invention may be applicable to a variety of enclosed structures having an opening that is closed by pivoting doors, such as refrigerators, freezers, wine cellars, cabinets, closets, cupboards, and other similar structures known to those of ordinary skill in the art. However, examples of the present invention may also be part of a larger structure, such as a building for an opening thereof, such as a window or door. The enclosed structure may have one or more doors that pivot to open or close a compartment and are hinged by assemblies, such as examples of the present invention. In one example of the present invention, two out-swinging doors (i.e., side-by-side or French style doors) can be provided to reveal the compartments of the enclosed structure, such as in a refrigerator or freezer.

Referring to the examples illustrated in FIGS. 1-3, 7, 8, 11, and 12, a hinge assembly 10 that is configured to adjust a height of doors 100 is shown as implemented on an enclosed structure 200, such as a cabinet. Although it is not limited thereto, the enclosed structure 200 enclosed by the doors 100 may be in the form of a domestic refrigerator/freezer unit.

The hinge assembly 10 illustrated in the figures is adapted to be mounted on a right side, as viewed by a user, of the enclosed structure 200. Thus, a hinge assembly 10 adapted to be mounted on a left side, as viewed by a user, of the enclosed structure 200 would substantially mirror the illustrated hinge assembly 10 in shape. A person of ordinary skill in the art will be able to make the accommodations necessary to construct a hinge assembly 10 adapted to be mounted on the left side based on the description below.

Referring to the examples illustrated in FIGS. 1-8 and 12, the hinge assembly 10 may include various elements, such as any or all of a mounting plate 12, a hinge plate 14, a height adjuster 16, a first cam element 18, a second cam element 20, a limiting plate 22, and a pivot pin 34.

The hinge plate 14 allows the hinge assembly 10 to be mounted near an opening of the enclosed structure 200 to support the door 100. Referring to the examples illustrated in FIGS. 1-3, 7, and 12, the hinge plate 14 may include a mounted portion 26 and a base portion 28. The mounted portion 26 of the hinge plate 14 may be oriented upright and elongate to extend across a surface of the enclosed structure 200 in a mounted state. The mounted portion 26 may include recesses or slots 30 that enable the hinge plate 14 to be removably or non-removably secured on an exterior of the enclosed structure 200 by way of fastening members, such as screws. The slots 30 may be horizontally elongate to promote fastening adjustability along the exterior of the enclosed structure 200. However, other means known in the art for securing the hinge plate 14 to the enclosed structure 200, such as gluing, nailing, or the like, may also be used.

The base portion 28 of the hinge plate 14 provides a surface on which other components of the hinge assembly 10 may be mounted. As shown in the examples illustrated in FIGS. 2 and 3, the base portion 28 may include a stopper 32 that is configured to limit a rotation range of the door 100, as will be described later. In this example, the base portion 28 is configured to extend laterally from a side of the enclosed structure 200. Near a proximal end, the base portion 28 has a rectangular hole 33 that is configured to releasably engage a rectangular bush 31 of the pivot pin 34.

The pivot pin 34 may include the rectangular bush 31, a splined portion 35, the threaded portion 36, and a cylindrical portion 37 that is neither threaded nor splined. The rectangular bush 31 may project downward from the threaded portion 36 and can be inserted into the rectangular hole 33 of the base portion 28 to secure the pivot pin 34. The pivot pin 34 may project vertically upward from a surface of the base portion 28 to define a rotational axis for the door 100. The insertion of the rectangular bush 31 into the rectangular hole 33 can enable the pivot pin 34 to remain stationary throughout rotation of the door 100 about the rotation axis created by the pivot pin 34.

The threaded portion 36 may be provided adjacent to the rectangular bush 31 on the pivot pin 34. The threaded portion 36 may be disposed above the base portion 28 of the hinge plate 14 when the rectangular bush 31 is secured by the rectangular hole 33 of the base portion 28. The threaded portion 36 may have threads around a circumference of the pivot pin 34 to accommodate internal threads 41 of the height adjuster 16.

Referring to the examples illustrated in FIGS. 1-3, 6, and 7, the height adjuster 16 may be an annular element having peripherally provided notches 40 arranged in various patterns, including, but not limited to, random patterns. The height adjuster 16 may also include coarse knurled surfaces 38 between the notches 40. The notches 40 and the knurled surfaces 38 can enable an operator to grasp the height adjuster 16 manually or with a tool, such as a wrench. The internal threads 41 and accommodations provided to the internal threads 41 by the threaded portion 36 of the pivot pin 34 can enable an operator that has grasped the height adjuster 16 to move the height adjuster 16 up or down relative to the threaded portion 36 of the pivot pin 34 by rotating the height adjuster 16 around the pivot pin 34 along the threaded portion 36.

In addition, as will be described further with respect to the first cam element 18, the height adjuster 16 may include, on a surface of the height adjuster 16 that faces away from the hinge plate 14, at least one planar knurled surface 39 that is less coarse than the knurled surfaces 38. In an example, the height adjuster 16 may be formed with two separate planar knurled surfaces 39 to ease assembly of the hinge assembly 10 and to moot any concern by an operator regarding the orientation of the height adjuster 16.

The splined portion 35 of the pivot pin 34 may be provided adjacent to the threaded portion 36 on the pivot pin 34 and separated from the rectangular bush 31 of the pivot pin 34 by the threaded portion 36. The splined portion 35 may include splines that are configured to mate with internal splines 44 formed in an inner circumferential portion of the first cam element 18. The splines of the splined portion 35 may be scattered circumferentially around the pivot pin 34. The splines may project vertically from the threaded portion 36 along the pivot pin 34. The mating of the internal splines 44 of the first cam element 18 with the splines of the splined portion 35 can serve to inhibit rotation of the first cam element 18 during rotation of the door 100 while allowing vertical adjustment of the first cam element 18 along the splines of the splined portion 35 of the pivot pin 34, the vertical adjustment corresponding to a position attained by the height adjuster 16 through rotation about the pivot pin 34.

The splined portion 35 of the pivot pin 34 and the internal splines 44 of the first cam element 18 may be shaped such that the first cam element 18 will fit on the pivot pin 34 in a single position in order to inhibit any possible assembly variation. In an example, the splines of the splined portion 35 may be evenly spaced around the pivot pin 34, and the internal splines 44 of the first cam element 18 may be formed to mate therewith. However, the placement and the shape of the splines on the splined portion 35 are not limited thereto, as the placement and the shape of the splines on the splined portion 35 around the pivot pin 34 may vary and/or be random, and the internal splines 44 of the first cam element 18 may be formed to mate therewith.

In addition, the first cam element 18 may include a knurled surface 47 that is configured to face the hinge plate 14 when the internal splines 44 of the first cam element 18 are mated with the splines of the splined portion 35 of the pivot pin 34. When the first cam element 18 is positioned on the splined portion 35 of the pivot pin 34 above the height adjuster 16, the knurled surface 47 of the first cam element 18 can mate with the planar knurled surface 39 of the height adjuster 16 to inhibit rotation of the height adjuster 16 around the pivot pin 34 along the threaded portion 36 that may otherwise be caused by repeated usage or downward force of the door 100.

For example, when an operator is not grasping the height adjuster 16 to move the height adjuster 16 up or down relative to the threaded portion 36 of the pivot pin 34 by rotating the height adjuster 16 around the pivot pin 34 along the threaded portion 36, the mating of the knurled surface 47 of the first cam element 18 with the planar knurled surface 39 of the height adjuster 16 can serve to inhibit movement of the height adjuster 16 along the threaded portion 36 of the pivot pin 34. In another example, when an operator is grasping the height adjuster 16 to move the height adjuster 16 up or down relative to the threaded portion 36 of the pivot pin 34 by rotating the height adjuster 16 around the pivot pin 34 along the threaded portion 36, the first cam element 16 can be moved axially along the pivot pin 34 by the rotation of the height adjuster 16.

As a result, the mating of the knurled surface 47 of the first cam element 18 with the planar knurled surface 39 of the height adjuster 16 facilitate a desired height of items that are placed above the height adjuster 16 and surrounding at least a portion of the pivot pin 34, including, but not limited to, the door 100. Moreover, the mating of the knurled surface 47 of the first cam element 18 with the planar knurled surface 39 of the height adjuster 16 can inhibit rotation of the height adjuster 16 around the pivot pin 34 along the threaded portion 36 such that a likelihood of the height adjuster 16 wiggling and/or shifting to a position other than a desired position along the threaded portion 36 as a result of repeated usage or downward force of the door 100 may be reduced.

Further, the first cam element 18 can be configured to control movement of the door 100 around an axis of the pivot pin 34. For example, the first cam element 18 may have a cam surface 50 on a side of the first cam element that is configured to face away from the hinge plate 14 and is opposite to that of the knurled surface 47. The cam surface 50 may include elevated portions 51, depressed portions 52, and transitioning portions 53 serving to connect the elevated portions 51 and the depressed portions 52. In an example, the cam surface 50 may include three elevated portions 51 and three depressed portions 52 respectively connected by three transitioning portions 53.

At the edge of the internal splines 44 that are formed in the inner circumferential portion of the first cam element 18, a central aperture or bore 46 may be formed through a center portion of the first cam element 18. The bore 46 can allow the cylindrical portion 37 of the pivot pin 34 to extend there through without constraint.

Figure 2:
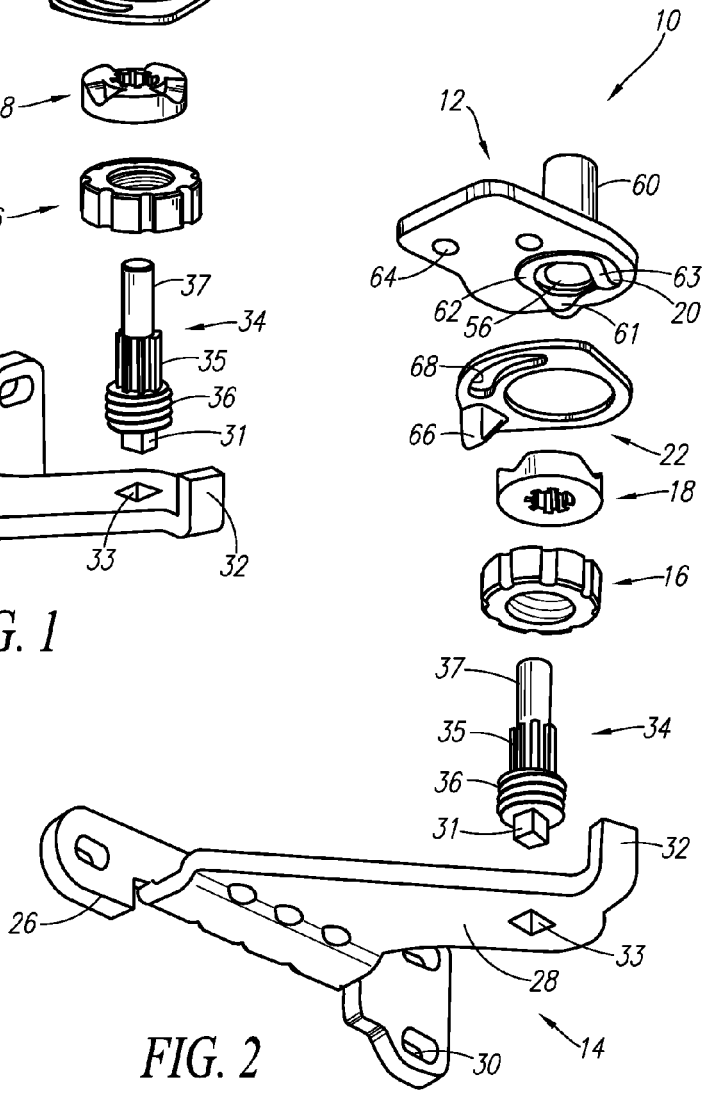
FIG. 2 is an exploded, top perspective view illustrating an example of the hinge assembly.
Figure 3:
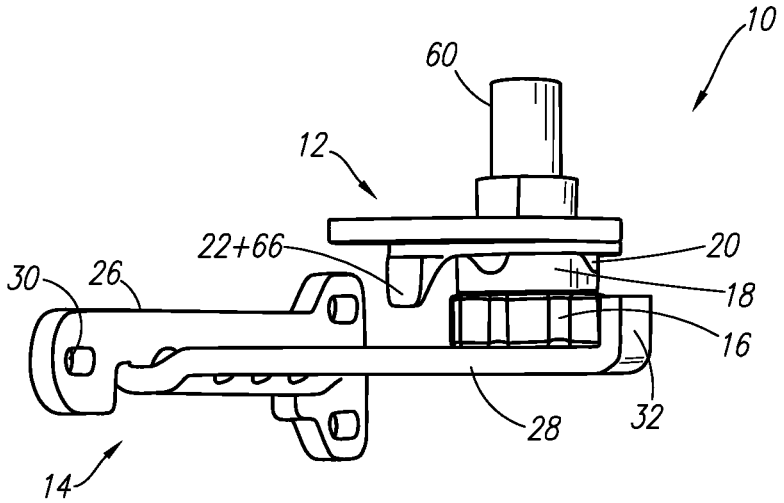
FIG. 3 is an assembled view illustrating an example of the hinge assembly.
Figure 4:
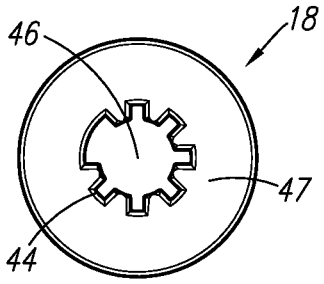
FIG. 4 is a bottom view illustrating an example of a first cam element of the hinge assembly.
Figure 5:
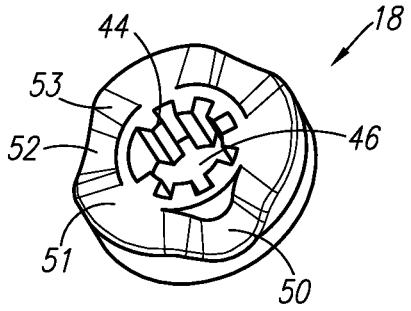
FIG. 5 is a top perspective view illustrating an example of a first cam element of the hinge assembly.
Figure 6:
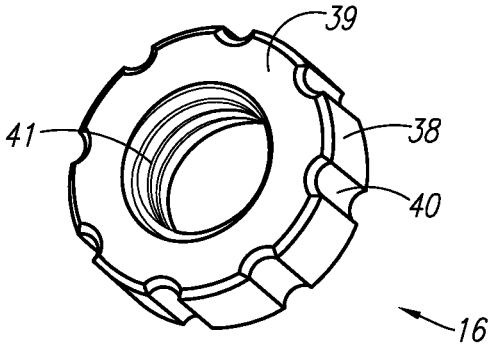
FIG. 6 is a top perspective view illustrating an example of a height adjuster of the hinge assembly.
Figure 7:
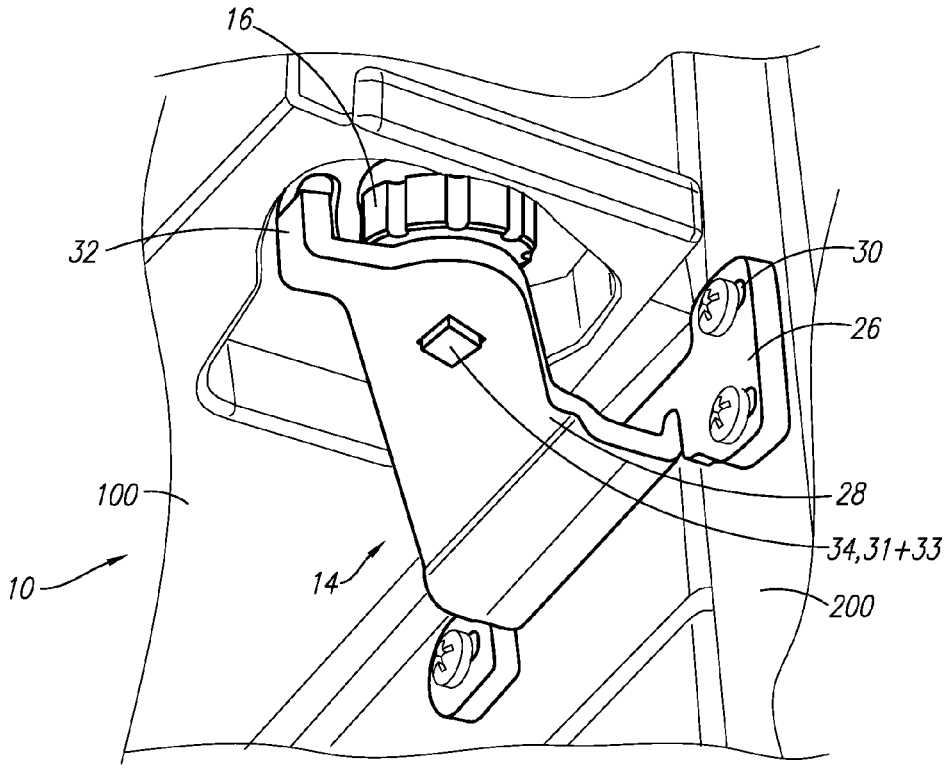
FIG. 7 is a bottom perspective view illustrating an example of the hinge assembly.
Figure 8:
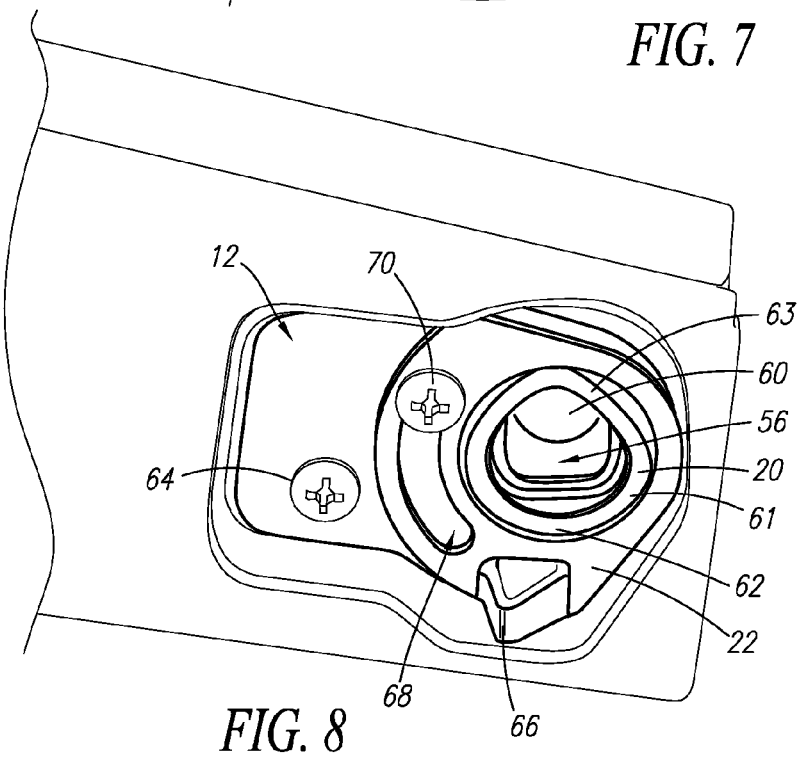
FIG. 8 is a bottom view illustrating an example of a mounting plate and a second cam element of the hinge assembly

Referring to the examples illustrated in FIGS. 2, 3, and 8, the first cam element 18 can be configured to interact with the second cam element 20 of the mounting plate 12. In this example, the second cam element 20 may be integrated into the mounting plate 12. However, the second cam element 20 is not limited thereto. For example, the second cam element 20 and the mounting plate 12 may be separate components that are attached together by fastening through welding, glue, or other fastening methods known to one having ordinary skill in the art.

The mounting plate 12 includes recesses or holes 64 configured to enable the securing of the mounting plate 12 to the door 100 via securing structures, such as screws. In addition, the mounting plate 12 may have a cylindrical hole 56 that is provided within an inner circumferential surface of the second cam element 20 and a corresponding portion of the mounting plate 12. A projection 60 of the hole 56 may be provided in the mounting plate 12 to project from the hole 56 to a side of the mounting plate 12 that is opposite a side of the mounting plate 12 on which the second cam element 20 can be disposed. The cylindrical portion 37 of the pivot pin 34 can be inserted through the hole 56 and the projection 60 of the hole 56 such that the mounting plate 12 and the second cam element 20 are allowed to rotate with movement of the door 100 around the pivot pin 34.

Around the hole 56, the second cam element 20 may include a surface having elevated portions 61, depressed portions 62, and transitioning portions 63 serving to connect the elevated portions 61 and the depressed portions 62. The elevated portions 61, depressed portions 62, and transitioning portions 63 of the second cam element may be configured to interact with the depressed portions 52, the elevated portions 51, and the transitioning portions 53 of the first cam element 18. The interaction between the depressed portions 52, the elevated portions 51, and the transitioning portions 53 of the first cam element 18 and the elevated portions 61, depressed portions 62, and transitioning portions 63 of the second cam element 20 can cause the second cam element 20 to be moved up and down as the second cam element 20 rotates around the pivot pin 34 according to the depressed portions 52, the elevated portions 51, and the transitioning portions 53 of first cam element 18.

In addition, the interaction between the depressed portions 52, the elevated portions 51, and the transitioning portions 53 of the first cam element 18 and the elevated portions 61, depressed portions 62, and transitioning portions 63 of the second cam element 20 may cause the door 100 to self-close or remain open depending on an angular position of the door 100. In an example, the door 100 can be configured to automatically return to a closed position when the angular position of the door 100 is between 0 to 20 degrees relative to a front face of the enclosed structure 200. In another example, the door 100 can be configured to automatically remain open when the angular position of the door 100 is 125 degrees or greater. In a further example, the door 100 can be configured to have more than two discrete angular positions to which the door 100 is biased.

Moreover, the angular positions at which the biased direction of the door 100 changes may vary. This variance can be made possible by the interaction between the elevated portions 61, the depressed portions 62, and the transitioning portions 63 of the second cam element 20 and the depressed portions 52, the elevated portions 51, and the transitioning portions 53 of the first cam element 18. Referring to the examples illustrated in FIGS. 1, 2, 5, and 8, the elevated portions 51 of the first cam element 18 may divide up the circumference of the first cam element 18 into a number of arced zones between which the elevated portions 61 of the second cam element 20 may be configured to move. In other words, when a tip of one of the elevated portions 61 of the second cam element 20 crosses over an edge of one of the elevated portions 51 of the first cam element 18, the weight of the door 100 may cause the tip of the one of the elevated portions 61 of the second cam element 20 to move along one of the transitioning portions 53 of the first cam element 18 from an elevation of the edge of the one of the elevated portions 51 of the first cam element 18 to an elevation of one of the depressed portions 52 of the first cam element 18, thereby serving to bias the door 100 toward one of the discrete angular positions.

In an example, the mounting plate 12 may be configured to accommodate the limiting plate 22. The limiting plate 22 may be secured at least partially around the second cam element 20 and the hole 56 of the mounting plate 12. However, the limiting plate 22 is not limited thereto. In an example, the limiting plate 22 may be mounted directly on the door 100. The limiting plate 22 may be substantially ring-shaped and include a hole configured to place the limiting plate 22 around the second cam element 20.

In addition, the limiting plate 22 may include a tab 66. The tab 66 can be configured to be caught by the stopper 32 on the base portion 28 of the hinge plate 14 to inhibit the door 100 from rotating to an angular position that is greater than a predetermined angular position. The tab 66 can be located at a distance from the rotational axis that is substantially equivalent to a distance from the rotational axis at which the stopper 32 is located.

The rotation range of the door 100 can be increased or decreased by adjusting a position of the limiting plate 22 with respect to the mounting plate 12 to control an angle at which the tab 66 is able to rotate prior to making contact with the stopper 32. The limiting plate 22 includes a slot 68 through which a fastener 70, such as a screw, is able to pass and secure the limiting plate 22 to the mounting plate 12. The slot 68 is curved and allows the limiting plate 22 to be rotated with respect to the mounting plate 12 when the fastener 70 is removed.

Figure 9:
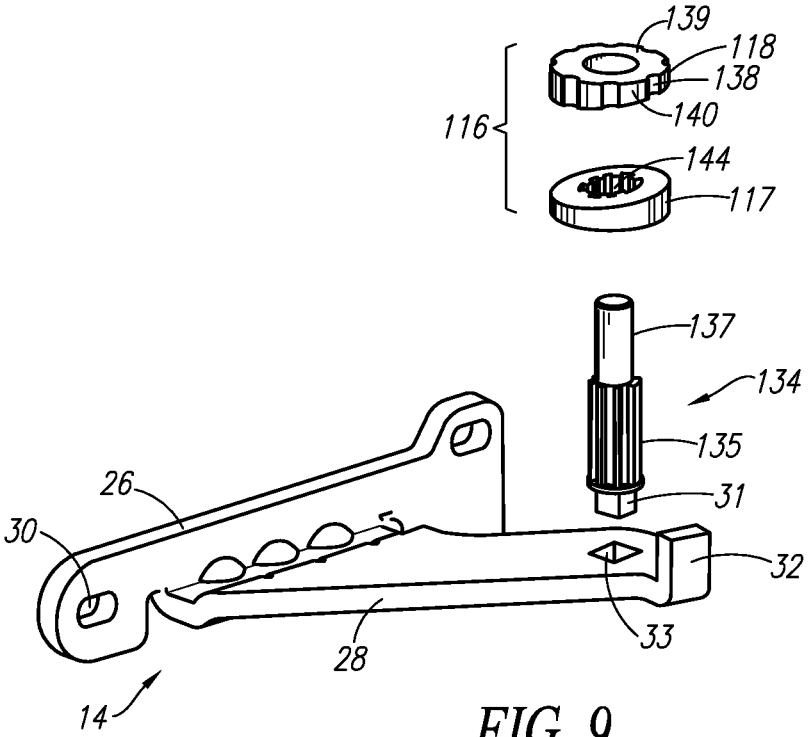
FIG. 9 is a partial exploded view illustrating another example of a hinge assembly for a door of an enclosed structure.

FIG. 9 is an exploded view illustrating another example of a hinge assembly for a door of an enclosed structure. Referring to the example illustrated in FIG. 9, a height adjuster 116 may be configured to interact with a pivot pin 134. While the height adjuster 116 is not limited in its formation, the height adjuster 116 may have a shape of a nut that can be split into a first wedge 117 and a second wedge 118 having opposingly varied thicknesses. The shape of the nut may be formed when a thickest portion of the first wedge 117 mates with a thinnest portion of the second wedge 118 and, simultaneously, a thinnest portion of the first wedge 117 mates with a thickest portion of the second wedge 118. The height adjuster 116 is at its thinnest when the first wedge 117 and the second wedge 118 mate to form the nut and thickest when the thickest portion of the second wedge 118 is contacting the thickest portion of the first wedge 117.

The first wedge 117 may be disposed at a position on the pivot pin 134 that is nearer to the hinge plate 14 than is the second wedge 118. Further, the pivot pin 134 may include a splined portion 135 that ranges from the rectangular bush 31 to a cylindrical portion 137 that is not splined, thereby omitting any portion that is threaded. The first wedge 117 may have an inner circumferential portion having internal splines 144 configured to mate with the splined portion 135, thereby serving to inhibit rotation of the first wedge 117.

The second wedge 118 may have an inner portion with a diameter as great as an outer diameter of the splined portion 135 of the pivot pin 134, thereby permitting the second wedge 118 to be rotatable around the pivot pin 134 while being in contact with the first wedge 117. When the second wedge 118 is rotated around the pivot pin 134 while in contact with the first wedge 117, the varying thicknesses of the first wedge 117 and the second wedge 118 can create a plurality of thicknesses for the height adjuster 116. In other words, the varying thicknesses of the second wedge 118 may be rotated around the pivot pin 134 to rest on the first wedge 117 such that a combined height of the first wedge 117 and the second wedge 118 is greater than a height of the first wedge 117 and the second wedge 118 when the nut is formed. As a result, the height adjuster 116, which is the combination of the first wedge 117 and the second wedge 118, may serve to elevate the items which are designated to rest thereupon, i.e. the first cam element 18.

In this example, similar to the height adjuster 16 featured in FIGS. 1-4 and 8, the second wedge 118 of the height adjuster 116 may be an annular element having peripherally provided notches 140 arranged in various patterns, including, but not limited to, random patterns. The second wedge 118 of the height adjuster 116 may also include coarse knurled surfaces 138 between the notches 140. The notches 140 and the knurled surfaces 138 can enable an operator to grasp the height adjuster 116 manually or with a tool, such as a wrench. The inner portion of the second wedge 118 with a diameter as great as an outer diameter of the splined portion 135 of the pivot pin 134 can enable an operator that has grasped the second wedge 118 to move the second wedge 118, and, subsequently, the height adjuster 116, up or down relative to the position of the first wedge 117 on which the second wedge 118 rests by rotating the second wedge 118 around the pivot pin 134 along the first wedge 117.

In addition, the second wedge 118 may include, on a surface of the second wedge 118 that faces away from the hinge plate 14, at least one planar knurled surface 139 that is less coarse than the knurled surfaces 138. When the first cam element 18 is positioned on the splined portion 135 of the pivot pin 134 above the second wedge 118, the knurled surface 47 of the first cam element 18 can mate with the planar knurled surface 139 of the second wedge 118 around the pivot pin 134 along the splined portion 135. As with the height adjuster 16, the mating of the knurled surface 47 of the first cam element 18 with the planar knurled surface 139 of the second wedge 118 can serve to inhibit movement of the second wedge 118 along the first wedge 117 and around the pivot pin 134 that may otherwise be caused by repeated usage or downward force of the door 100.

As a result, the mating of the knurled surface 47 of the first cam element 18 with the planar knurled surface 139 of the second wedge 118 can facilitate a desired height of items that are placed above the second wedge 118 of the height adjuster 116 and surrounding at least a portion of the pivot pin 134, including, but not limited to, the door 100. Moreover, the mating of the knurled surface 47 of the first cam element 18 with the planar knurled surface 39 of the second wedge 118 of the height adjuster 116 can inhibit rotation of the second wedge 118 of the height adjuster 116 around the pivot pin 134 along the splined portion 135 such that a likelihood of the second wedge 118 of the height adjuster 116 wiggling and/or shifting to a position other than a desired position along the splined portion 135 as a result of repeated usage or downward force of the door 100 may be reduced.

Figure 10:
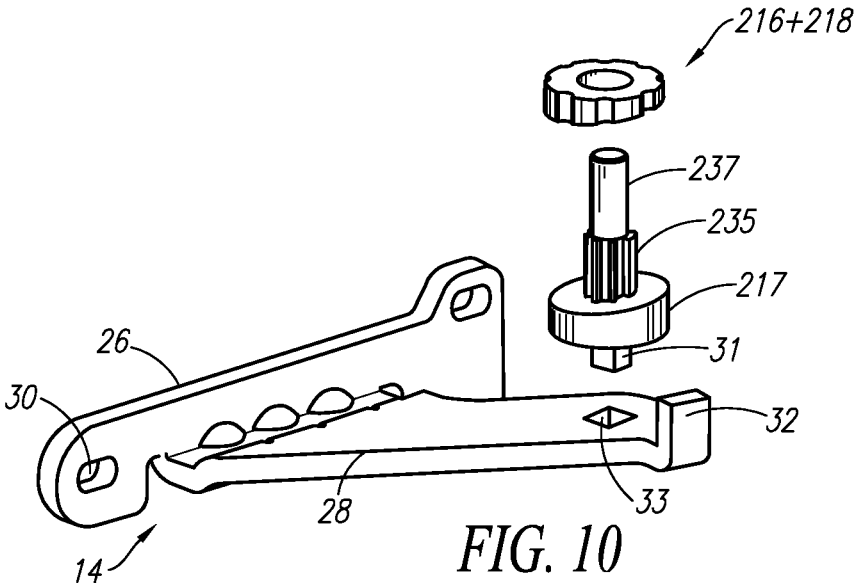
FIG. 10 is a partial exploded view illustrating yet another example of a hinge assembly for a door of an enclosed structure.
Figure 11:
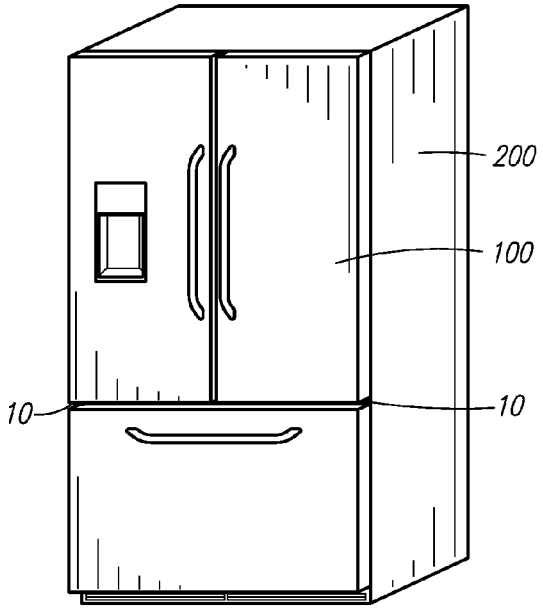
FIG. 11 is a perspective view illustrating an example of the enclosed structure on which the door is mounted using an example of the hinge assembly for the door of the enclosed structure.
Figure 12:
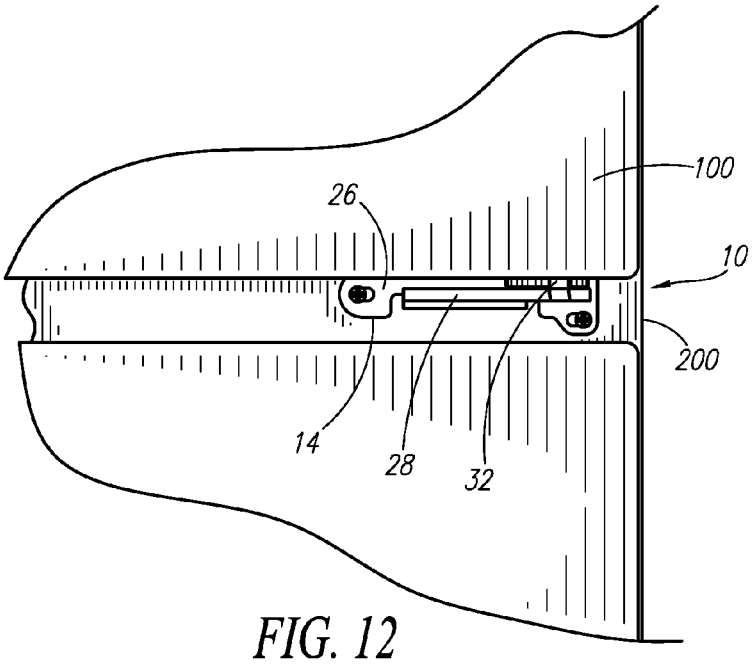
FIG. 12 is a front view illustrating an example of the door mounted on the enclosed structure using an example of the hinge assembly for the door of the enclosed structure.

FIG. 10 is an exploded view illustrating yet another example of a hinge assembly for a door of an enclosed structure. Referring to the example illustrated in FIG. 10, a height adjuster 216 may be configured to interact with a pivot pin 234. The first wedge 217 is similar to the first wedge 117 illustrated in FIG. 9, except that the first wedge 217 may be fixed as a part of the pivot pin 234. As a result, the pivot pin 34 may include the rectangular bush 31, a first wedge 217, a splined portion 235, and a cylindrical portion 237 that is not splined. The second wedge 118 of the height adjuster 216 can interact with the splined portion 235 and the first wedge 217 of the pivot pin 234 in the same way that the second wedge 118 of the height adjuster 116 can interact with the splined portion 135 of the pivot pin 134 and the first wedge of the height adjuster 116.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A hinge assembly for mounting a door on a cabinet below an opening thereof, the hinge assembly comprising:

a hinge plate configured to mount the door to the cabinet, the hinge plate comprising a hole extending through the hinge plate;

a pin configured to define an axis about which the door rotates, the pin being supported by the hinge plate and comprising a bush, a splined portion, a threaded portion, and a cylindrical portion, the bush and the cylindrical portion being positioned at opposite ends of the pin, the threaded portion being positioned between the bush and the splined portion, the splined portion being positioned between the threaded portion and the cylindrical portion, the bush extending into the hole in the hinge plate, the bush engaging walls of the hole in the hinge plate to limit rotation of the pin;

a height adjuster comprising a threaded hole threaded onto the threaded portion of the pin and a knurled surface on a side of the height adjuster that faces away from the hinge plate;

a first cam element comprising a splined hole through which the splined portion of the pin extends, the splined hole engaging the splined portion of the pin to inhibit rotation of the first cam element, a cam surface facing away from the height adjuster, and a knurled surface engaging the knurled surface of the height adjuster to inhibit rotation of the height adjuster about the pin; and a mounting plate comprising a second cam element interacting with the first cam element, the second cam element comprising a cylindrical hole through which the cylindrical portion of the pin extends and a cam surface interacting with the cam surface of the first cam element, the cylindrical hole comprising an projection into which the cylindrical portion of the pin is positioned and a diameter that is greater than an outer diameter of the splined portion of the pin, the engagement of the cam surfaces of the first and second cam elements being configured to control a position and an action of the door, the projection being rotatable about the pin and configured to fit into a hole in the door and rotate about the pin with the mounting plate, wherein the height adjuster is configured to move vertically on the pin when rotated about the pin thereby adjusting the height of the door.

2. The hinge assembly of claim 1, further comprising:

a limiting plate fastened to the mounting plate and surrounding the second cam element and the pin, the limiting plate being configured to rotate about the pin with the door, the limiting plate comprising a tab, wherein the hinge plate comprises a stopper, the stopper being configured to inhibit the door from rotating past a predetermined position, and wherein the predetermined position is defined by a position at which the tab contacts the stopper.

3. The hinge assembly of claim 1, wherein the cam surface of the first cam element comprises elevated portions, depressed portions, and transitional portions connecting the elevated portions and the depressed portions.

4. The hinge assembly of claim 3, wherein the cam surface of the second cam element comprises elevated portions, depressed portions, and transitioning portions connecting the elevated portions and the depressed portions, and wherein the elevated portions, the depressed portions, and the transitioning portions of the second cam element interact with the elevated portions, the depressed portions, and the transitioning portions of the first cam element.

5. The hinge assembly of claim 4, wherein the elevated portions of the cam surface of the first cam element divide a circumference of the cam surface of the first cam element into a plurality of arced zones between which the elevated portions of the cam surface of the second cam element are configured to move in order to control the position and the action of the door.

6. The hinge assembly of claim 1, wherein, when an angular range defined by the position of the door and a point at which the door meets the opening of the cabinet is 0 to 20 degrees, the cam surface of the second cam element is configured to interact with the cam surface of the first cam element to urge the door to the point at which the door meets the opening of the cabinet.

7. The hinge assembly of claim 1, wherein, when an angular range defined by the position of the door and a point at which the door meets the opening of the cabinet is 125 degrees or greater, the cam surface of the second cam element is configured to interact with the cam surface of the first cam element to maintain the angular range.

8. The hinge assembly of claim 1, wherein the hinge plate comprises slots configured to allow mounting of the hinge plate on the cabinet below the opening thereof to be adjustable perpendicular to the axis.

9. The hinge assembly of claim 1, wherein the hole of the hinge plate comprises a rectangular hole, and wherein the bush of the pin comprises a rectangular bush projecting from the pin and mating with the rectangular hole.

10. The hinge assembly of claim 1, wherein the projection is cylindrical to facilitate the rotation of the door about the axis.

11. The hinge assembly of claim 1, wherein the splined portion of the pin comprises a plurality of splines extending from the threaded portion to the cylindrical portion of the pin, each of the splines protruding perpendicular to the axis away from a center of the pin and further from the center of the pin than an outer circumference of the cylindrical portion.

12. The hinge assembly of claim 1, wherein the height adjuster further comprises a plurality of outer knurled surfaces positioned on an outer circumference of the height adjuster, and wherein the outer knurled surfaces are configured to enable grabbing of the forcibly mated height adjuster to enable forcible rotation of the threaded hole about the pin.

13. The hinge assembly of claim 1, wherein the protrusion is integrally formed in the mounting plate.

* * * * *